US008628104B1

(12) United States Patent
Stare et al.

(10) Patent No.: US 8,628,104 B1
(45) Date of Patent: Jan. 14, 2014

(54) WHEELCHAIR FOOTREST TETHER

(76) Inventors: John Stare, Hoffman Estates, IL (US); Iliana I. Georgieva, Chicago, IL (US)

( * ) Notice: Subject to any disclaimer, the term of this patent is extended or adjusted under 35 U.S.C. 154(b) by 0 days.

(21) Appl. No.: 13/385,654

(22) Filed: Feb. 23, 2012

(51) Int. Cl.
*A61G 5/10* (2006.01)

(52) U.S. Cl.
USPC ..... 280/304.1

(58) Field of Classification Search
USPC ..... 280/250.1, 304.1; 297/423.19, 423.22, 297/423.25; 224/407
See application file for complete search history.

(56) References Cited

U.S. PATENT DOCUMENTS

2002/0114679 A1* 8/2002 Craft ..... 410/7
2008/0251554 A1* 10/2008 Hassett et al. ..... 224/407
2009/0012666 A1* 1/2009 Simpson et al. ..... 701/23
2012/0228350 A1* 9/2012 Bennett et al. ..... 224/407

* cited by examiner

*Primary Examiner* — Tony Winner
(74) *Attorney, Agent, or Firm* — Dillis V. Allen, Esq.

(57) ABSTRACT

A tether system for the removable leg supports of a wheelchair to prevent the misplacement of the leg supports when they are removed to facilitate the loading or unloading of a patient from the wheelchair. The leg supports are tethered with a pair of cord rewind assemblies fixed to the inside frame of the wheelchair to conserve space. These rewind mechanisms permit the nurse to remove the leg supports from the wheelchair, extend the respective cords from the rewind assemblies to a desired temporary storage location, and automatically lock the cord and the leg supports in that extended position until the cord is pulled slightly releasing the lock and permitting the cords to be rewound or retracted when the nurse remounts the leg supports on the wheelchair frame assembly.

12 Claims, 4 Drawing Sheets

WHEELCHAIR FOOTREST TETHER

BACKGROUND OF THE INVENTION

The loss or misplacement of the leg supports on wheelchairs has become a major problem in the institutional health care industry. In this environment, there may be dozens of wheelchairs in a small area, such as a rehabilitation area, or an open residential area, or even a dining area.

When transferring a patient from a wheelchair to another location such as a bed, chair, van or toilet, it is usually more convenient and sometimes necessary to remove the leg supports from interfering with patient movement or preventing the wheelchair from moving closely to an obstruction. This problem is present even in wheelchairs with swing out leg supports, such as manufactured by Invacare[1] Corporation.

1. Invacar® is a registered trademark of Invacare Corporation of Elyria, Ohio.

As a practical matter, these crowded wheelchair areas result in the confusion of which leg supports go with which wheelchair because they are different from one wheelchair to another.

There have been prior attempts to solve these problems including providing brackets on the wheelchair frame as exemplified in U.S. Pat. No. 7,487,989 to Crosby, II issued on Feb. 10, 2009. This solution makes the problem worse by enlarging the envelope of the wheelchair.

Another attempt provides covers for the leg supports wherein the covers are locked to the wheelchair arms after removal. This system for a Footrest and Legrest Assembly Storage Bag for Wheelchair is manufactured by Amerisoft Medical at amerisoftmedical.com.

Another system is shown in the Google download of MedicalProductsDirect.com. for "Wheelchair Footstraps and Foot-Pad Accessories".

SUMMARY OF THE PRESENT INVENTION

In accordance with the present invention, a wheelchair footrest tether assembly is provided for the removable leg supports of a wheelchair to prevent the misplacement of the leg supports when they are removed to facilitate the loading or unloading of a patient from the wheelchair. The leg supports are tethered with a pair of cord rewind assemblies fixed to the inside frame of the wheelchair to conserve space. These rewind mechanisms permit the nurse to remove the leg supports from the wheelchair, extend the respective cords from the rewind assemblies to a desired temporary storage location, and automatically lock the cord and the leg supports in that extended position until the cord is pulled slightly releasing the lock and permitting the cords to be rewound or retracted when the nurse remounts the leg supports on the wheelchair frame assembly.

The cord rewind assemblies operate in a similar manner to the auto-release-lock electric cord rewind assemblies found today on vacuum cleaners such as Hoover and Eureka.

Other objects and advantages of the present invention will appear more clearly from the following detailed description.

DETAILED DESCRIPTION OF THE PREFERRED EMBODIMENT

Figure 1:
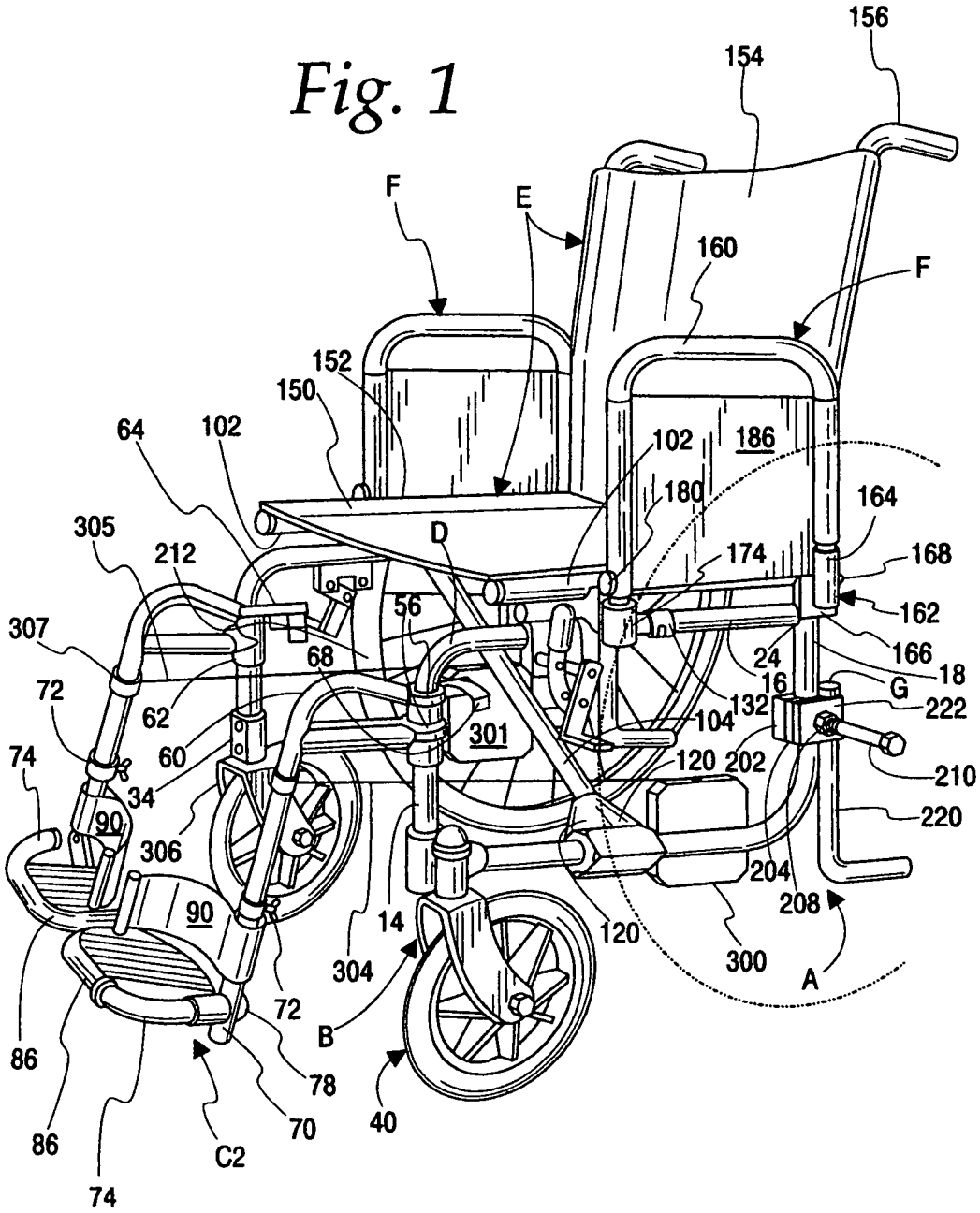
FIG. 1 is a perspective view of the present wheelchair assembly with removable and tethered leg rest assemblies.

According to the drawings and particularly FIG. 1, the present wheelchair assembly includes side frames A, leg support assemblies C, a seat assembly E, arm rest assemblies F, a curved step mounting assembly G, and a pair of rewind assemblies 300 and 301 attached inside the side frame assemblies F, each tethered to the foot rest assemblies $C_2$ and $C_1$ respectively, so that when the foot rest assemblies $C_1$ and $C_2$ are removed from the wheelchair assembly, the tethers 304 and 305 attached to the footrest assemblies by brackets 306 and 307, prevent the leg and foot rest assemblies $C_1$ and $C_2$ from being completely separated from the wheelchair assembly in accordance with the misplacement problem described above.

With reference to FIG. 1, the wheelchair includes a pair of identical side frames A. Front wheel assemblies B and leg support assembles $C_1$ and $C_2$ are connected to a forward portion of the side frames. A folding mechanism D selectively enables the side frames to be moved together for more compact storage and easier handling. A seat E supports the operator. Selectively removable arm rest assemblies F are pivotally connected to the side frames to enable the arm support to be either pivoted relative to the frame or completely removed. A real wheel and curb step mounting assembly G selectively mounts rear wheels to the side frame and reinforces their interconnection.

Figure 2:
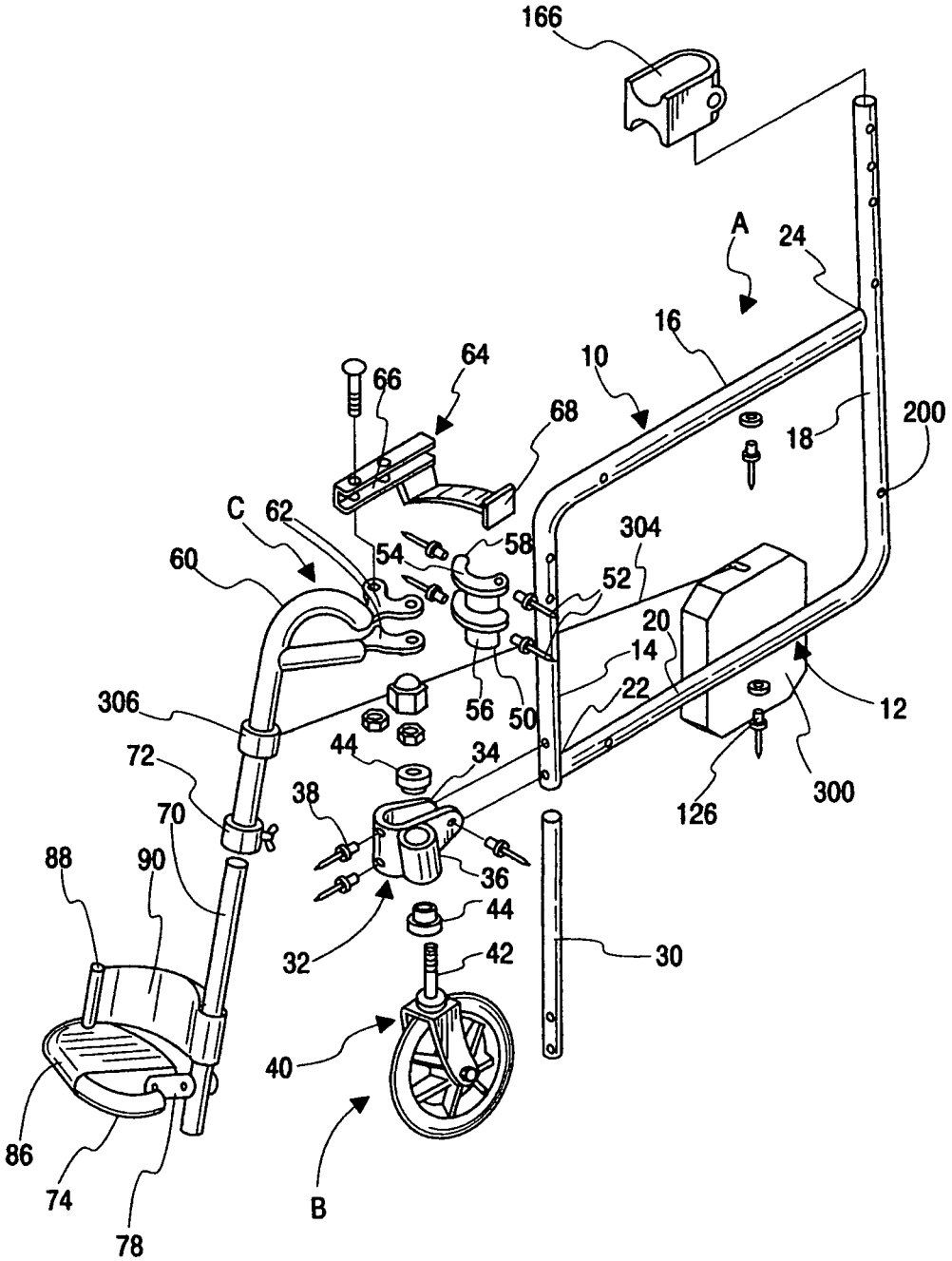
FIG. 2 is an exploded sub-assembly of one side frame assembly with a rewind mechanism according to the present invention fixed to the inside frame and tethered to the leg rest assembly.

With particular reference to FIG. 2, the side frames A are each constructed of relatively thin walled, light weight tubing, such as aluminum, magnesium, titanium and their alloys. Thin walled steel tubing is also contemplated. Because the left and right side frames are identical, to simplify inventory demands, only one of the side frames will be described in detail and it is to be appreciated that the description applies equally to both. the side frame consists of only a first generally L-shaped tubing section 10 and a second generally L-shaped tubing section 12. The first L-shaped tubing section includes a first or forward generally vertically disposed tubular portion or forward leg 14 which is integrally connected by a bend with a first or upper generally horizontally disposed tubular portion or leg 16. The second L-shaped tubing section includes a second or rearward generally vertically disposed tubular portion or leg 18 and a second or lower generally horizontally disposed tubular portion or leg 20. The L-shaped tubing sections are welded at a forward lower interconnection 22 and a rearward upper interconnection 24. The forward, lower weld junction is reinforced by the front wheel mounting assembly B and the rearward upper weld joint is reinforced by the arm support assemblies F. This reinforcing of the welds with other assemblies facilitates the use of lighter weight tubing without sacrificing the reliability and durability of tubing junctions. In the preferred embodiment, the second, rearward vertical tubular portion extends upward beyond the upper rearward weld 24 to mount a portion of the seat E thereon. Optionally, a separate tubing portion may be interconnected to the side frame by a hinge or the like to support the upper seat portion.

The front wheel assemblies B are each connected with a corresponding one of the side frames A. A reinforcing tube 30 is slidably received in the front, vertical side frame tubing portion 14 to provide greater structure strength. A front wheel mounting bracket 32 is mounted to the side frame adjacent the forward, lower weld 22 to mount front wheel casters and to reinforce the weld. More specifically, the front wheel assembly mount includes a generally U-shaped bracket 34 to which a tubular portion 36 is welded. The bracket 34 and the tubular portion 36 are configured and interconnected to be symmetric about a horizontal axis such that the mount can be rotated top for bottom and used on the opposite side of the chair. Mechanical fasteners 38 extend through corresponding bores in the U-shaped bracket 34, the side frame forward, vertical tubular frame portion 14 and the lower horizontal frame portion 20, and the reinforcing tube 30. The mechanical fasteners may be bolts, pop-rivets or the like. A front wheel caster 40 has an upstanding post 42 which is mounted by appropriate bearings and other mounting means 44 to the front wheel mounting assembly bracket tube 36. Due to the symmetry of the mount, the stud 42 and the bearings and other mounting structures 44 may be inserted into the tubular portion 36 from either direction to enable the same parts to be used as either a right or left front wheel assembly.

With continuing reference to FIG. 2, the front leg support assembly C includes a mounting bracket 50 which is interconnected by mechanical fasteners 52 with corresponding apertures in the front generally vertical tubular frame portion 14 and the reinforcing tube 30. Each leg rest mounting bracket includes a pair of cams 54 which have pivot pins 56 at one end and locking surfaces 58 at their other ends. Optionally, the pivot pins 56 may extend symmetrically through the cam surfaces to enable the bracket 50 to be inverted top to bottom for placement on the opposite side of the frame.

An upper leg support mounting member 60 has a pair of hinge plates 62 that have apertures for receiving pins 56 of the mounting bracket 50. A spring biased cam follower assembly 64 is pivotally mounted to one of the hinge plates such that a spring biases a follower portion 66 thereof against the corresponding one of cams 54. The cam follower portion 66 is spring biased to lock behind the locking surfaces 58 when the leg support member is facing straightforward. By pressing a manual, release lever 68, the cam follower 66 is biased against the spring out of contact with the stop surfaces 58 to allow the leg assembly to pivot on pivot pins 56. The hinge members 62 may be asymmetric to limit their mounting to the left or right side of the chair to prevent the leg rest assemblies from being mounted backwards. Optionally, the hinge members may be symmetric about a central axis and define pivot holes on either side thereof. The symmetric positioning of holes for the cam follower enables the leg rest to be mounted on either side of the chair.

Figure 3:
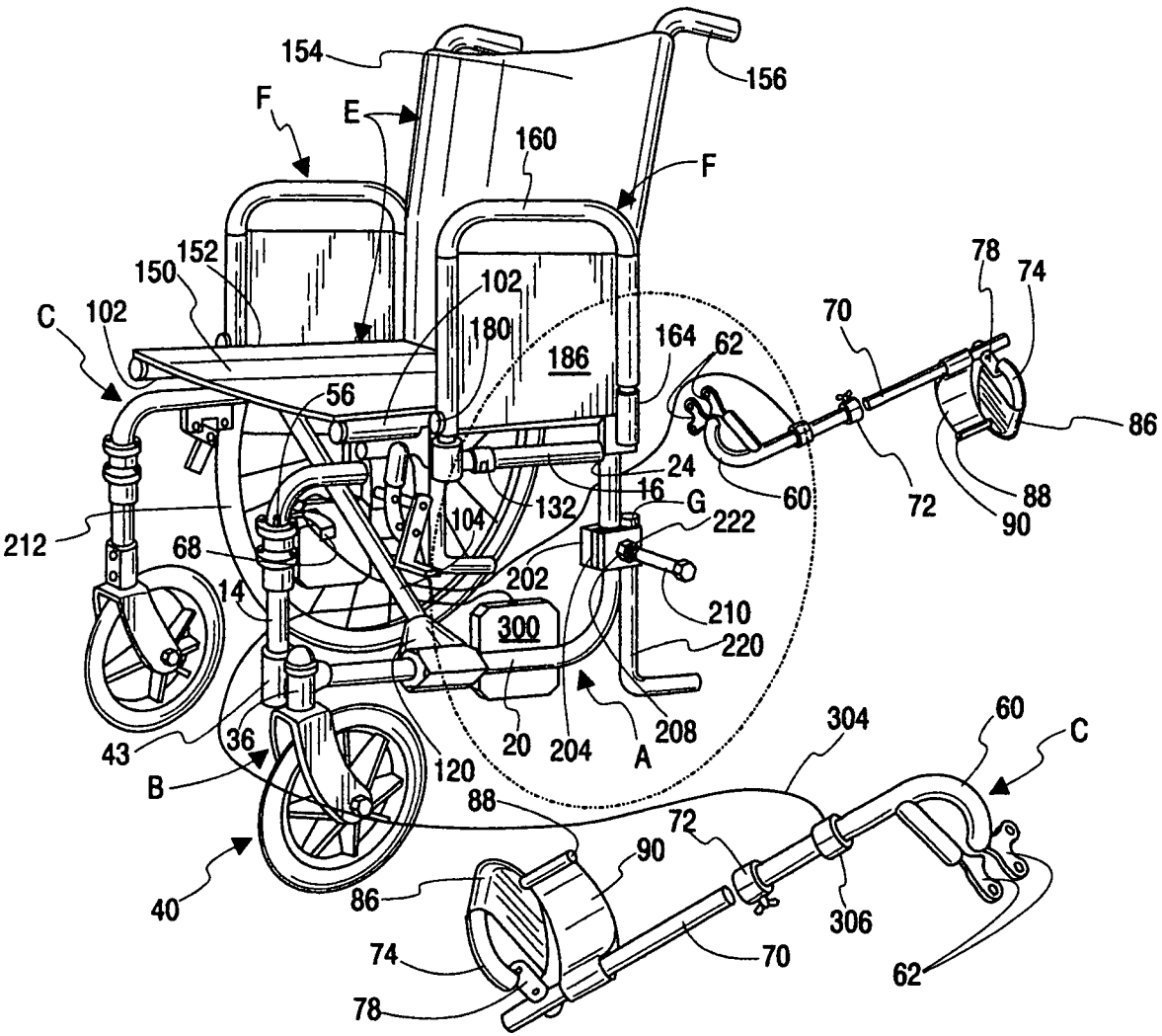
FIG. 3 is a perspective view of the present wheelchair assembly similar to FIG. 1 with the leg rest removed from the wheelchair and placed on the floor while remaining tethered to the respective rewind assemblies.

With continuing reference to FIG. 2 and further reference to FIG. 3, a foot support extension tube 70 is telescopically received in portion 60 with a degree of telescopic receipt set by a clamping means 72. A generally U-shaped foot rest member 74 is connected by mechanical fasteners 76 to a mounting bracket 78. The generally U-shaped member 74 and the mounting bracket 78 are the same for both left and right side foot rests, but their interconnection is reversed by 180 degrees. Another mechanical fastener 80 pivotally interconnects the bracket 78 with the extension tube 70. A solid plus 82 provides increased structural strength to the lower end of tube 70. An adjustable stop, such as a bolt 84 is tapped into the plug 82 and abuts the bracket 78. By adjusting the distance with which the stop 84 extends from the plug 82, the rest position of the foot rest is selectively adjustable.

A molded plastic foot rest cover 86 slides over the U-shaped tube 74 and is anchored thereto by a post 88. A foot support strap 90 is telescopically received over the extension tube 70 and the post 88. The post 88 is mounted symmetrically in the U-shaped portion 74 such that the foot rest cover 86 may be utilized with either the left or right side.

Figure 4:
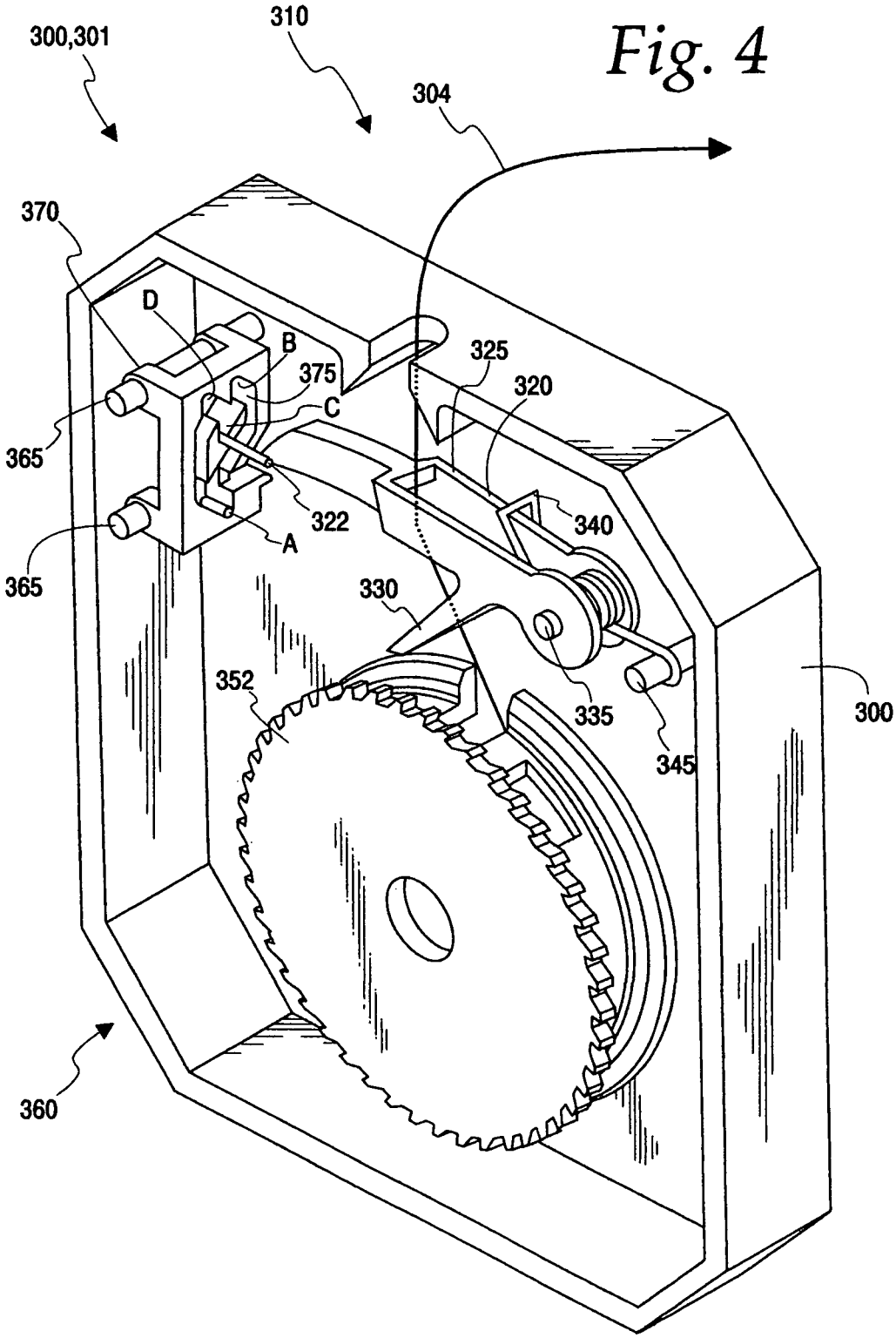
FIG. 4 is a perspective view of one of the rewind assemblies according to the present invention with its cover plate removed.

With continuing reference to FIG. 1 and further to FIGS. 4 and 5, the folding mechanism D is interconnected with the side frames A and the seat E. The folding mechanism includes to identical generally T-shaped seat support structures 100. Each seat support structure includes a seat support member 104. The cross brace member is interconnected with the seat support member 104 offset from its center such that the seat side support member 102 defines a longer free end 106 and a shorter free end 108. The cross brace members are interconnected by a pivot joint 110 which may include a nylon spacer or the like 112 between the cross members. The relative lengths of the longer and shorter free ends are selected relative to the diameter of the cross brace members and the thickness of any washer 112 such that the forward most ends of the seat support member are parallel and the rearward most ends of the seat support members are parallel.

A fitting 120 is interconnected with the lower end of each cross member for rotatable interconnection with the lower horizontal side frame tubular portion 20. More specifically, the fitting 120 defines a side frame receiving passage 122 extending longitudinally therefore for rotatably receiving the tubular side frame portion. To maintain the horizontal side frame portion and the folding mechanism in proper alignment, the fitting defines a groove 124 extending circumferentially. A projection 126, such as a pop rivet mounted to the side frame, is slidably received in the circumferentially extending groove. The groove is offset in the same direction as the longer free end 106 of the seat support structure such that it is substantially in alignment across the chair. Both side frames have an aperture bored in the same place the same distance from the front of the frame to receive the mechanical fastener 126. In this manner, the reversibility of the side frames is assured.

As alignment link 130 is pivotally connected at one end with the cross member 104 and has a fitting or connection 132 at its other end which defines an upper generally horizontal extending frame side tube passage 134. The fitting 132 defines a circumferentially extending groove or slot 136 which receives a projection 138 projecting from the upper, horizontally extending tubular side frame portion 16. The circumferentially extending groove or slot 136 is again aligned with the center of the pivot washer 112 such that bores or apertures for the projections 138 are in the same location on both left and right side frames. This enables the side frames to be interchanged without boring additional apertures.

With reference again to FIG. 1, the seat E includes a lower seat portion 150 of flexible cloth which is anchored by screws 152 or the like to the seat side supports 102. A seat back portion 154 wraps around and is secured to the rear generally vertical side frame tubular members 18 and telescopically received hand grip portions 156.

With continuing reference to FIG. 1 and further reference to FIGS. 8 and 9, the arm support structure F includes an arm support member 160 such as a generally U-shaped tube upon which the user's arm may rest. A rearward end of the arm support structure is connected with a first mounting bracket 162 that has a portion 164 which is pivotal relative to the side frames. More specifically, a combined seat side support receiving cradle, weld reinforcing member and first mounting bracket base 166 is connected with the side frame adjacent upper rearward weld 24 to reinforce the weld, support the seat side support 102 when the chair is open, and to have the portion 164 pivotally mounted thereon. A stop 168 limits pivoting movement of the first mounting bracket. A spring detent 170 and release means 172 or other means for releasably securing the arm supporting structure rear end to the first mounting bracket permits the arm support structure to be selectively disconnected therefrom.

Referring again now to the drawings, and to FIG. 4, rewind mechanisms 300,301 are described. A housing comprises first portion 360 in which the rewind mechanism is mounted and a second portion (not depicted for illustrative purposes) that closes the housing. The second portion is attached to the first portion, for example, by gluing, welding or an inner lip which is press fit into the first portion 360 as is well known in the art.

Flexible member 304 is wound around the central axis 355 of spool 352. For illustrative purposes, only a segment of flexible member 304 is shown. However, one of ordinary skill in the art will realize that nearly any desired length of flexible member 304 may be wound onto spool 352 depending upon the dimensions of spool 352.

Spool 352 is rotatably mounted within housing 360 as is well known in the art. Spool 352 is biased to rotate in a clockwise direction by a biasing element, for example, a helix, torsion or coil spring (not shown), as is well known in the art. Exemplary manners for biasing spool 352 to rotate are described in U.S. Pat. Nos. 2,521,178 to Meleth (see FIG. 1 and corresponding description) 5,481,607 to Hsiao (see FIG. 5 and corresponding description), 6,536,697 to Tsan (see FIGS. 3 and 7 and corresponding description) and 6,736,346 to Park (see FIG. 3 and corresponding description); all of which are fully incorporated herein by reference. The biasing element (not shown) rotates spool 352 in order to rewind flexible member 304 after it has been pulled out of housing 360. As is well understood by one of ordinary skill in the art the rotation direction of the biasing element could be reversed with simple modifications to teeth 350 on spool 352, to stop arm 330 and to the biasing element (not shown).

The legrest assemblies are connected to flexible member 304 and prevent flexible member 304 from being completely wound around central axis 355. This prevents flexible member 304 from being completely withdrawn within housing 360 where a user cannot grasp it.

Another manner for preventing flexible member 304 from completely withdrawing into housing 360 is to configure the biasing element to stop rewinding before a free end of flexible member 304 disappears into housing 360.

Arm 320 is pivotally mounted about pin 335 within housing 360. In FIG. 1, pin 335 is molded as an integral part of housing 360. Pin 335 could also be fixed to housing 360 in any well known manner such as, but not limited to, a bolt or other threaded fastener, gluing, welding or a rivet. A spring 340 engages arm 320 and housing 360 via post 345. Spring 340 biases arm 320 towards spool 352. Alternatively, arm 320, or select portions of arm 320, are made from an elastic material, for example a flexible plastic or spring steel. In these alternative embodiments, arm 320 is rigidly attached to pin 335, or directly to housing 360. In these alternative embodiments, spring 340 is not needed to bias arm 320 towards spool 352 as the elastic deformation of arm 320 will bias arm 320 towards spool 352.

Arm 320 is configured with an opening containing a post 325. In FIG. 1 post 325 is fixed at both ends to arm 320 and is made from a smooth material that provides frictional engagement with flexible member 304. For example, depending upon the amount of friction required to move arm 320, post 325 can be made of a hard material, for example a hard plastic covered with a softer plastic or a durable rubber such as Santoprene$^R$. An alternative construction for post 325 is to make post 325 with a rotatable cover over it, for example a bushing or nylon sleeve, which will provide frictional engagement for flexible member 304 and decrease the wear caused by flexible member 304 passing over post 325.

An alternate construction for post 325 within arm 320 is to place post 325 in a position (for example, moving post 325 in the direction towards guide post 322) where flexible member 304 engages, e.g., is pinched by, both post 325 and arm 320. For such an embodiment, arm 320 does not need to be made from a flexible material and spring 340 is not needed. The force of flexible member 304 moving between post 325 and arm 320 is sufficient to rotate arm 320 away from spool 352 when flexible member 304 is pulled. The force of flexible member 304 moving between post 325 and arm 320 is also sufficient to rotate arm 320 towards spool 352 when flexible member 304 is rewound by the biasing element (not shown). In such an embodiment, there is always resistance to movement of flexible member 304. Referring to FIG. 5, such an embodiment placing constant resistance to movement of flexible member 304 is made, for example, by wrapping one or more complete turns of flexible member 304 onto guide roller 325.

Referring again to FIG. 1, flexible member 304 is positioned through the opening in arm 320 and interacts with post 325 in such a manner that pulling on flexible member 304 places a force (Force A in FIGS. 2 and 4), for example through friction, on post 325. The force resulting from pulling flexible member 304 outside housing 360 overcomes the biasing force from spring 340 (or the internal force of arm 320 if it is a flexible material rigidly attached to pin 335 or housing 360) and causes arm 320 to rotate away from spool 352.

Guide post 322 on arm 320 is configured to interact with a track 375 contained on plate 370. Stop arm 330 on arm 320 is configured to interact with teeth 350 on spool 352 in a manner that prevents the biasing element (not shown) from rotating spool 352. The present invention is not limited to a ratchet and pawl type stop mechanism, but uses any suitable mechanism such as frictional engagement or a post that fits into grooves or holes, for example.

Plate 370 is slidably mounted within housing 360 on posts 365. Other manners for slidably mounting plate 370, for example, on a flexible beam extending from a wall of housing 360, or a ball joint sliding within a groove are also covered by the present invention. As arm 320 and guide post 322 rotate away from and towards spool 352 guide post 322 impacts walls within track 375. Guide post 322 impacting the walls within track 375 causes plate 370 to slide on posts 365 which permits guide post 322 to move between positions C, D, B and A within track 375. Alternatively, guide post 322 and/or arm 320 (or select portions of arm 320), can be made from an elastic material (as described above) and plate 370 can be fixedly mounted within housing 360. Such an embodiment permits guide post 322 to move between positions C, D, B and A by impacting walls within plate 370 and deflecting enough to be guided to one of positions C, D, B or A. Another alternative construction used with an elastic guide post 322 and/or arm 320 is to make track 375 directly in the wall of housing 360 so that no plate 370 is required. In FIG. 4 track 375 is depicted with an opening to the outside of plate 370. the opening to the outside of plate 370 is to facilitate assembling the rewind mechanism 35 by making it easier to insert guide post 322 into track 375. The opening to the outside of plate 370 is not necessary to the functioning of rewind mechanism 5.

Referring now to FIG. 4, operation of the depicted embodiment of the inventive rewind mechanism 5 is described. With flexible member 304 fully wound around central axis 355, e.g., with attachment device 310 abutting housing 360 or with the biasing element (not shown) not exerting any rotational force upon spool 352, guide post 322 rests in position C within track 375 as depicted in FIG. 1. While guide post 322 rests in position C, stop arm 330 does not interact with teeth 350 on spool 352.

Flexible member 304 is pulled from housing 360 which exerts Force A upon post 325. The force upon post 325 is sufficient to overcome the force exerted by spring 340, or the internal stiffness of arm 320 if it is rigidly attached to pin 335 or housing 360 in other embodiments, and causes arm 320 to rotate away from spool 352. As arm 320 rotates away from spool 352 guide post 322 moves within tract 375, impacts a wall within track 375 sliding plate 370 on posts 365 and relocating to position D. While flexible member 304 is being pulled from housing 360 guide post 322 remains in position D. Stop arm 330 remains free from engaging teeth 350 and spool 352 rotates as flexible member 304 is pulled from housing 360. Pulling flexible member 304 also transfers mechanical energy to the biasing element (not shown) so that the biasing element has enough energy to completely rewind the flexible member 304 about central axis 355.

When flexible member 304 is no longer pulled from housing 360 Force A exerted on post 325 subsides and spring 340, or the internal stiffness of arm 320, or the resistance to movement of flexible member 304 through arm 320, causes arm 320 to rotate towards spool 352. As arm 320 moves towards spool 352 the biasing element (not shown) rotates spools 352 and rewinds a small amount of flexible member 304 about central axis 355. Guide post 322 impacts a wall within tract 375 sliding plate 370 on posts 365 and moving from position D to position A. As illustrated in FIG. 3, arm 320 is still rotating towards spool 352, and guide post 322 is moving into position A. As illustrated in FIG. 3, arm 320 is still rotating towards spool 352, and guide post 322 in moving into position A. Alternatively, guide post 322 and/or arm 320 have enough flex to move through track 375 when plate 370 is fixedly mounted within housing 360 or when track 375 is directly formed in a wall of housing 360. With guide post 322 in position A, stop arm 330 interacts with teeth 350 to prevent spool 352 from rotating and further rewinding flexible member 304 about central axis 355. While guide post 322 remains in position A stop arm 330 prevents spool 352 from rotating due to the force exerted by the biasing element (not shown). The portion of flexible member 304 which was pulled from housing 360 remains outside housing 360 without any tension placed on it by the biasing element (not shown).

When it is desired to rewind flexible member 304 about central axis 355 within housing 360 an additional amount of flexible member 304 is pulled from housing 360. This exerts Force A upon post 325 which, again, is sufficient to overcome the force exerted by spring 340, or the internal stiffness of arm 320 if it is rigidly attached to pin 335 or housing 360, causing arm 320 to rotate away from spool 352. As arm 320 rotates away from spool 352 guide post 322 moves within track 375, impacts a wall within track 375 sliding plate 370 on posts 365 and relocates to position B. While the additional amount of flexible member 304 is being pulled from housing 360 guide post 322 remains in position B. Stop arm 330 is moved free from engaging teeth 350 and spool 352 rotates as flexible member 304 is pulled from housing 360. Pulling flexible member 304 also transfers additional mechanical energy to the biasing element (not shown) so that the biasing element has enough energy to completely rewind flexible member 304 about central axis 355.

After an additional amount of flexible member 304 is pulled from housing 360 flexible member 304 is released. The Force A exerted on post 325 subsides and spring 340, or the internal stiffness of arm 320, causes arm 320 to rotate towards spool 352. As arm 320 moves towards spool 352 the biasing element (not shown) rotates spool 352 and rewinds flexible member 304 about central axis 355. Guide post 322 impacts a wall within tract 375 sliding plate 370 on posts 365 and moves from position B to position C. Stop arm 330 is held free from teeth 350 to allow spool 352 to rotate and further rewind flexible member 304 about central axis 355. The portion of flexible member 304 which was pulled from housing 360 is rewound within housing 360 by the biasing element (not shown).

Flexible member 304 can be completely rewound into housing 360 while guide post 322 remains in position C. Rewinding stops when attachment device 310 abuts housing 360, or when the biasing element stops rotating spool 352—depending upon the design as discussed above. Additionally, rewinding can be interrupted by pulling on flexible member 304. Guide post 322 will then move to position A, as described above in relation to FIG. 3, when flexible member 304 is no longer pulled. Any portion of flexible member 304 that is outside housing 360 will remain outside housing 360 at this time. Thus, the portion of flexible member 304 outside housing 360 can be shortened (or lengthened) without first rewinding all of flexible member 304 into housing 360.

The embodiment of the inventive rewind mechanism depicted in FIG. 4 is also designed to prevent flexible member 304 from becoming locked outside housing 360. One end of flexible member 304 is securely attached to spool 352 as is well known in the art. Thus, it is possible to pull flexible member 304 outside housing 360 until only the portion of flexible member extending from its attachment point to spool 352 to the opening in housing 360 remains within housing 360. In the event that flexible member 304 is pulled this far outside housing 360 the distance guide post 322 must move from position D to position A within track 375 is far enough to rewind a sufficient amount of flexible member 304 onto spool 352 to permit guide post 322 to move from position A to position B. Thus, pulling out too much of flexible member 304 to prevent guide post 322 from moving between positions C, D, B and A within track 375 is avoided.

The invention claimed is:

1. A wheelchair assembly, comprising:

a generally rectangular frame assembly having generally parallel side members connected together, a pair of leg supports removably attached to the frame assembly, at least one tether cord fixing each of the leg support to the frame assembly when the leg supports are disassembled from the frame assembly, and at least one rewind assembly for the tether cord mounted between and inside the parallel side members.

2. A wheelchair assembly as defined in claim 1, wherein the at least one tether cord includes two tether cords each attached to one of the leg supports.

3. A wheelchair assembly as defined in claim 2, wherein the at least one rewind assembly includes two rewind assemblies, said each of the tether cords is rewindable into one of two rewind assemblies mounted on the frame assembly.

4. A wheelchair assembly as defined in claim 3, wherein each of the rewind assemblies is fixed to one of the frame assembly side members.

5. A wheelchair assembly as defined in claim 4, wherein a mounting arrangement of the rewind assemblies is to reduce the outer width of the wheelchair.

6. A wheelchair assembly as defined in claim 1, wherein the wheelchair is collapsible by bringing the side members together.

7. A rewind tether assembly for a wheelchair having a frame assembly with generally parallel side members connected together with leg supports removably attached to the frame assembly, comprising:

at least one tether fixed to the leg supports, and a rewind assembly fixed to the frame assembly for extending and retracting the at least one tether as the leg supports are removed and replaced from the frame assembly, said rewind assembly for the tether cord being mounted between and inside the parallel side members.

8. A rewind tether assembly as defined in claim 7, wherein the at least one tether cord includes two tether cords each attached to one of the leg supports.

9. A rewind tether assembly as defined in claim 8, wherein the at least one rewind assembly includes two rewind assemblies and each of the tether cords is rewindable into one of two rewind assemblies mounted on the frame assembly.

10. A rewind tether assembly as defined in claim 9, wherein each of the rewind assemblies is fixed to one of the frame assembly side members.

11. A rewind tether assembly as defined in claim 10, wherein the frame assembly side members further including inner sides and outer sides, and each of the rewind assemblies is fixed to an inner side of one of the frame assembly side members to reduce an outer width of the wheelchair.

12. A rewind tether assembly as defined in claim 7, wherein the wheelchair is collapsible by bringing the side members together.

* * * * *